United States Patent [19]

Wada

[11] 4,371,478

[45] Feb. 1, 1983

[54] VARIABLE VENTURI CARBURETOR

[75] Inventor: Satomi Wada, Obu, Japan

[73] Assignee: Aisan Kogyo Kabushiki Kaisha, Japan

[21] Appl. No.: 283,471

[22] Filed: Jul. 15, 1981

[30] Foreign Application Priority Data

Jul. 22, 1980 [JP] Japan ..... 55-103604[U]

[51] Int. Cl.[3] ..... F02M 9/06

[52] U.S. Cl. ..... 261/44 C; 261/DIG. 39

[58] Field of Search ..... 261/44 C, 44 B, DIG. 39

[56] References Cited

U.S. PATENT DOCUMENTS

| | | | |
|---|---|---|---|
| 1,453,490 | 5/1923 | Bessom | 261/DIG. 39 |
| 1,875,713 | 9/1932 | Dusevoir | 261/DIG. 39 |
| 2,229,819 | 1/1941 | Reid | 261/DIG. 39 |
| 3,956,434 | 5/1976 | Dickensheets et al. | 261/44 C |
| 4,146,596 | 3/1979 | Saito et al. | 261/DIG. 39 |
| 4,259,266 | 3/1981 | Nakamura | 261/44 C |
| 4,276,238 | 6/1981 | Yoshikawa et al. | 261/44 C |
| 4,290,399 | 9/1981 | Takada et al. | 261/44 C |

FOREIGN PATENT DOCUMENTS

| | | | |
|---|---|---|---|
| 747986 | 10/1944 | Fed. Rep. of Germany | 261/44 B |
| 731762 | 9/1932 | France | 261/44 C |
| 488462 | 7/1938 | United Kingdom | 261/44 B |
| 369289 | 4/1973 | U.S.S.R. | 261/44 C |

*Primary Examiner*—Tim R. Miles

*Attorney, Agent, or Firm*—Blair, Brown & Kreten

[57] ABSTRACT

Disclosed herein is an improvement in a variable venturi carburetor for an internal combustion engine including a fuel discharging main nozzle arranged in a venturi portion and a suction piston arranged in an opposite side of the main nozzle for reciprocating in response to the variation of negative pressure of air induced to the engine generated at the venturi portion and varying an area of an induction passage of the venturi portion. The improvement includes that a fore-most end of the main nozzle is projected into the venturi portion and a fuel guide member is arranged at a lower portion of the projecting portion of the main nozzle. The fuel guide member serves to guide a flow of liquid fuel when the flow rate of air flowing through the venturi portion is low and the liquid fuel is discharged through the main nozzle.

2 Claims, 5 Drawing Figures

VARIABLE VENTURI CARBURETOR

BACKGROUND OF THE INVENTION

1. Field of the Invention

The present invention relates to a variable venturi carburetor to be installed in an internal combustion engine for automobiles.

2. Description of the Prior Art

In recent years, the automotive industry has continually exerted efforts to meet the governmentally imposed standards on exhaust emissions and to increase the fuel economy of automotive engines. One of these efforts includes to develop such technology as to run an engine stably with a relatively lean fuel-air mixture and a low idle engine speed. The prior art in trying to meet the above requirements has employed an idle and low speed system in addition to a main metering system for a fuel passage in a variable venturi carburetor. According to this prior art, the air-fuel ratio in a variable venturi carburetor is controlled by altering an annular area defined between a main jet and a metering needle. The problems associated with this type of carburetor include that it is sometimes difficult for the main jet and the metering needle which control air-fuel ratio to respond quickly to a change in the fuel flow rate in the idle and low speed system. Furthermore, there arises another problem that it is costly to install an idle and low speed system in a variable venturi carburetor.

SUMMARY OF THE INVENTION

Accordingly, it is the primary object of the present invention to provide a variable venturi carburetor without requiring an idle and low speed system, wherein a main metering system of the variable venturi carburetor is comprised of a main nozzle projected into a venturi portion at the fore-most end thereof and a fuel guide member formed at the lower part of the main nozzle, so that the variable venturi carburetor can supply fuel stably to an engine even when the flow rate of air introduced into the venturi portion is small at idle engine operation, for example.

It is another object of the present invention to provide a variable venturi carburetor enabling an engine to be operated stably, whereby the air-fuel ratio can be reduced with an increased fuel economy.

It is further object of the present invention to provide a variable venturi carburetor wherein an improper transition from an idle and low speed engine operation to a middle and high speed engine operation is obviated resulting that the shift from a low speed to a high speed may be smoothly effected.

It is still further object of the present invention to provide a variable venturi carburetor which is low in cost owing to the elimination of an idle and low speed system.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENT

Figure 1:
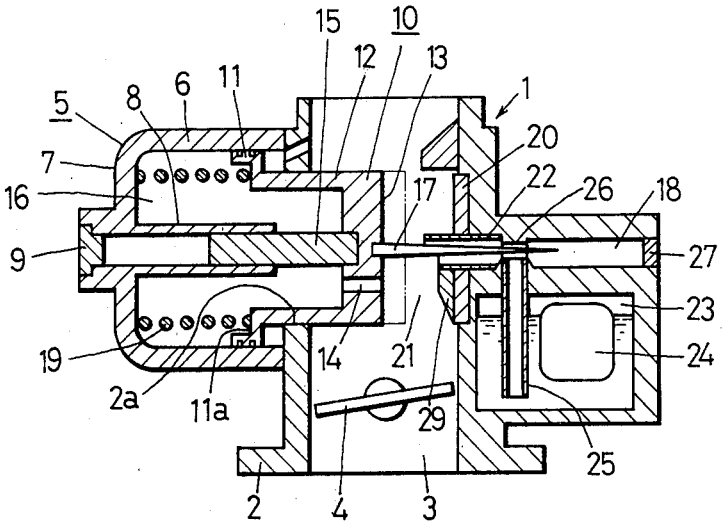
FIG. 1 is a longitudinal cross sectional view of a carburetor employing teachings of the present invention.
Figure 3:
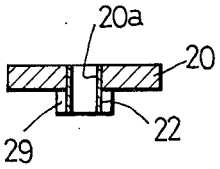
FIG. 3 is a cross sectional view taken aong line III—III of FIG. 2.

Referring now to FIG. 1, a variable venturi carburetor 1 is comprised of a throttle valve 4 provided within a bore portion 3 of a body 2. A suction cylinder 5 is situated at one side upstream of the throttle valve 4 within the body 2. The cup-like suction cylinder 5 is comprised of a cylindrical side wall 6 and a bottom plate 7 at one end thereof, which cylinder is secured to the upper side surface of the body 2 by means of a bolt (not shown) at the opposed side of the bottom plate 7. A guide sleeve 8 extends inwardly from the center portion of the bottom plate 7 of the suction cylinder 5 and is adapted to receive a guide rod 15 of a suction piston 10. The guide sleeve 8 is sealingly covered at the outermost end by means of a plug 9. The suction piston 10 is provided with an annular slide portion 11 which is sealingly slidable along the inner surface of the side wall 6 of the suction cylinder 5. The suction piston 10 is provided with a cylindrical side wall 12 inwardly projecting and having smaller diameter than that of the slide portion 11, and provided with a top plate 13 situated at the opposed side of the slide portion 11 and having an aperture 14. The side wall 12 of the suction piston 10 is slidably retained within a lateral opening **2*a* of the body 2 and the top plate 13 is projected into the bore portion 3. A guide rod 15 is mounted to the top plate 13 at the center of the inner surface thereof and is slidably retained within the guide sleeve 8 of the suction cylinder 5. A suction chamber 16 is defined by the suction cylinder 5 and the suction piston 10. A metering needle 17 is mounted to the top plate 13 at the center of the outer surface thereof. The metering needle 17 is formed in a conical configuration with its cross sectional area decreased toward the foremost end away from the outer surface of the top plate 13, and is reciprocatingly received into a fuel passage 18 opening to the opposed surface of the top plate 13. The aperture 14 bored through the top plate 13 of the suction piston 10 is located downstream of the metering needle 17, that is, at the same side of the throttle valve 4. A coil-like compression spring 19 is provided between a ridge portion 11*a* formed inside of the slide portion 11 and the bottom plate 7 of the suction cylinder 5. The suction piston 10 is urged away from the bottom plate 7 by means of the compression spring 19 and the top plate 13 is projected into the bore portion 3. A disc 20, the diameter of which is substantially equal to that of the top plate 13, is carried on the inner wall surface of the bore portion exposed to the opposed top plate 13 of the suction piston 10, so that a venturi portion 21 is defined between the top plate 13 and the disc 20. The disc 20 is provided with an opening 20*a* communicating with the fuel passage 18 at the central portion thereof (See FIG. 3). A cylindrical main nozzle 22 is received into the opening 20*a* and a portion of the fuel passage 18 leading from a main jet 26 which is described hereinafter to the opening 20*a*. In the prior art, the inner end of the main nozzle 22 is arranged in alignment with the inner surface of the disc 20. A fuel well 25 is situated in such a manner that the lower end thereof may be positioned in the fuel stored within a float chamber 23 having a float 24 therein and the upper end of the fuel well 25 may be projected into the fuel passage 18. The cross sectional area of the portion of the fuel passage 18 where the fuel well 25 is projected is designed so as to be smaller than that of the other portion of the fuel passage 18 to define a main jet 26. The fuel passage 18 is covered at the opposed end of the main nozzle 22 by means of a plug 27**.

When an engine vacuum does not exist downstream of the throttle valve 4 in the above described carburetor 1, the suction piston 10 is biased away from the bottom plate 7 by means of the compression spring 19 and the slide portion 11 of the suction piston 10 abuts against the outer wall surface of the bore portion 3 (as depicted by phantom line in FIG. 1). Under such a condition, the venturi portion 21 is most closely restricted. When the throttle valve 4 is moved in the opening direction causing an engine vacuum to be generated, atmospheric air is induced into the bore portion 3 of the carburetor 1 causing the velocity of air flow through the venturi portion 21 to be increased and causing a vacuum to be created in the aperture 14 of the suction piston 10. The vacuum thus created in the aperture 14 is developed within the suction chamber 16 defined by the suction cylinder 5 and the suction piston 10 causing the suction piston 10 to be attracted toward the suction cylinder 5 against a resilient force of the compression spring 19. Accordingly, the area of the venturi portion 21 is increased. The lateral movement of the suction piston 10 causes the metering needle 17 to move in the same direction and the opening area of the main jet 26 to be increased. As the flow rate of air through the venturi portion 21 increases and the vacuum created in the aperture 14 becomes larger, the magnitude of the movement of the suction piston 10 increases, while as the flow rate of air through the venturi portion 21 decreases and the vacuum created in the aperture 14 becomes smaller, the magnitude of the movement of the suction piston 10 decreases. In this manner, the suction piston 10 laterally reciprocates in response to the flow rate of air through the venturi portion 21 so that the metering needle 17 mounted on the suction piston 10 laterally reciprocates within the main jet 26, which causes a change in the annular area defined by the main jet 26 and the metering needle 17 and at the same time, in the rate of fuel flow discharged from the main nozzle 22.

Figure 2:
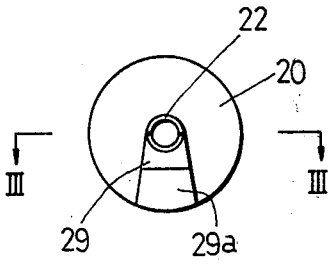
FIG. 2 is a top plan view of a disc of the carburetor on which a fuel guide member is mounted.
Figure 4:
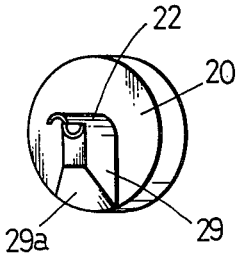
FIG. 4 is a perspective view of FIG. 2.

According to the present invention, one end of the main nozzle 22 is somewhat projected into the venturi portion 21 and plate-like fuel guide member 29 is carried by the disc 20 and abuts against the lower end portion of the main nozzle 22. As shown in FIG. 2, the width of the upper portion of the fuel guide member 29 is substantially equal to the outer diameter of the main nozzle 22 and the width of the lower portion of the fuel guide member 29 is slightly larger than that of the upper portion thereof. The thickness of the fuel guide member 29 is substantially equal to the lateral projection of the lower portion of the main nozzle 22 at the upper portion thereof and is sequentially reduced from the central portion of the lower-most end thereof to thereby define a bevel surface 29*a*. The lower-most edge of the bevel surface 29*a* is registered with the circumferential edge of the disc 20.

In operation, when the opening degree of the throttle valve 4 is relatively small, with the engine running at idle and low speeds, the air flow through the venturi portion 21 is decreased and its velocity is low. As the result, the vacuum created in the aperture 14 of the suction piston 10 is relatively low so as to cause the suction piston 10 to be biased outwardly by means of the compression spring 19. At this moment, the annular area defined between the metering needle 17 and the main jet 26 is minimum and the fuel amount metered at this position and supplied through the fuel well 25 into the main nozzle 22 is very little. For this reason, the fuel discharged from the main nozzle 22 flows along the inner surface of the fuel guide member 29 and thereafter through the inner wall surface of the bore portion to the throttle valve 4. The fuel flowing to the throttle valve 4 is atomized by air to be induced through the outer periphery of the throttle valve 4 and supplied to an engine intake manifold (not shown).

As should be apparent, at a low velocity of air flowing through the venturi portion 21, the fuel discharged from the main nozzle 22 flows along the inner surface of the fuel guide member 29 and is stably supplied downstream along the inner wall surface of the bore portion 3 through the throttle valve 4 to an engine intake manifold.

It should be still apparent that the throttle valve 4 is progressively moved in the opening direction causing the velocity of air flowing through the venturi portion 21 to increase and causing the suction piston 10 to move laterally. This, of course, allows fuel discharging from the main nozzle 22 to be brought into a suspended particle condition of fuel-air mixture in the same manner as the prior art.

Figure 5:
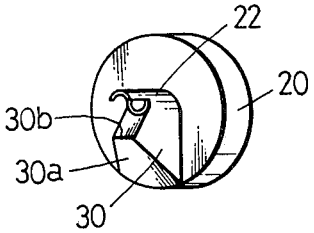
FIG. 5 is a perspective view of a disc on which a fuel guide member is mounted according to another embodiment.

Referring to FIG. 5 in particular, there is shown an alternate embodiment of the fuel guide member according to the present invention. In this embodiment, the fuel guide member 30 is provided with a triangular lateral projection in side elevation at the central portion 30*b*.

While the invention has been described with reference to a few preferred embodiments thereof, it is to be understood that modifications or variations may be easily made without departing from the scope of this invention which is defined by the appended claims.

What is claimed is:

1. In combination with a variable venturi carburetor for an internal combustion engine including a fuel discharging main nozzle arranged in a venturi portion and a suction piston arranged in an opposite side of said main nozzle, said suction piston being reciprocated in response to the variation of negative pressure of air induced to the engine generated at the venturi portion and varying an area of an induction passage of the venturi portion, a variable venturi carburetor comprising a fore-most end of said main nozzle projecting into the venturi portion and a fuel guide member arranged at a lower portion of said fore-most end of said main nozzle for guiding a flow of liquid fuel when the flow rate of air flowing through the venturi portion is low and the liquid fuel is discharged through the main nozzle wherein the width of the upper portion of said fuel guide member is substantially equal to the outer diameter of said main nozzle and the width of the lower portion of said fuel guide member is slightly larger than that of the upper portion thereof and the thickness of said fuel guide member is substantially equal to the lateral projection of the lower portion of said main nozzle at the upper portion thereof and is sequentially reduced from the central portion toward the lowermost end thereof to define a bevel surface.

2. In combination with a variable venturi carburetor for an internal combustion engine including a fuel discharging main nozzle arranged in a venturi portion and a suction piston arranged in an opposite side of said main nozzle, said suction piston being reciprocated in response to the variation of negative pressure of air induced to the engine generated at the venturi portion and varying an area of an induction passage of the venturi portion, a variable venturi carburetor comprising a fore-most end of said main nozzle projecting into the venturi portion and a fuel guide member arranged at a lower portion of said fore-most end of said main nozzle for guiding a flow of liquid fuel when the flow rate of air flowing through the venturi portion is low and the liquid fuel is discharged through the main nozzle wherein said fuel guide member is provided with a triangular lateral projection in side elevation at the central portion thereof into the venturi portion.

* * * * *